United States Patent [19]

Ippolito

[11] Patent Number: 4,560,127

[45] Date of Patent: Dec. 24, 1985

[54] PAINT CADDY

[76] Inventor: Vincent A. Ippolito, 5442 W. Parker, Chicago, Ill. 60639

[21] Appl. No.: 476,514

[22] Filed: Mar. 18, 1983

[51] Int. Cl.[4] ..... E06C 7/14

[52] U.S. Cl. ..... 248/210; 182/106

[58] Field of Search ..... 248/210, 211, 238, 291; 182/106

[56] References Cited

U.S. PATENT DOCUMENTS

| | | | |
|---|---|---|---|
| 2,622,833 | 12/1952 | Robinson | 248/211 |
| 2,912,205 | 11/1959 | Toune | 248/210 |
| 3,029,054 | 4/1962 | Mott | 248/211 |
| 3,278,148 | 10/1966 | Denaro | 248/210 |
| 3,310,270 | 3/1967 | Ciancio | 248/210 |
| 3,980,264 | 9/1976 | Tomasik | 248/210 |
| 3,987,993 | 10/1976 | Hopkins | 248/210 |
| 4,082,387 | 4/1978 | Davis | 248/291 |

FOREIGN PATENT DOCUMENTS

| | | | |
|---|---|---|---|
| 1544265 | 4/1979 | United Kingdom | 248/210 |

OTHER PUBLICATIONS

Popular Mechanics Magazine; Jul. 1947, p. 126.

*Primary Examiner*—Ramon S. Britts
*Assistant Examiner*—Ramon O. Ramirez
*Attorney, Agent, or Firm*—Dressler, Goldsmith, Shore, Sutker & Milnamow, Ltd.

[57] ABSTRACT

A device for removably mounting a paint can from either side rail of a ladder comprises a support assembly including a channel-shaped section having a central portion with first and second side panels extending therefrom for mounting the device to either side rail of the ladder and a hook member secured to one of the side panels for supporting the device from a rung of the ladder; a receptacle comprising a cylindrical member having an open upper end for holding the paint can; and an arm secured to the receptacle and pivotably connected to the other side panel whereby the device can be mounted from either side rail of the ladder to maintain the rim of the paint can in a horizontal position regardless of the angle of incline of the ladder.

1 Claim, 7 Drawing Figures

PAINT CADDY

BACKGROUND OF THE INVENTION

The present invention relates in general to a device for supporting a paint can or bucket from a ladder and, in particular, to a device for removably mounting a paint can from either side rail of a ladder whereby the can is maintained in a level or horizontal position regardless of the angle of incline of the ladder.

The prior art includes many devices which can be used to support a can or bucket from a ladder or the like. But, as will be shown, none of the devices disclosed by the prior art suggest the construction of the present invention.

In particular, Berry (U.S. Pat. No. 1,221,650) relates to a support for paint buckets which includes an angle bar 2 adapted to engage a rail of a ladder, a pivotable vertical arm 6 and a receptacle 14 secured to an extension of the arm for holding a paint can. It should be noted that the angle bar 2 is held on the rail by a clamping member 4 that, unlike the present invention, engages both the upper and lower surfaces of the rail. To adjust the position of the device along the rail, the clamping means must be loosened or disengaged (see FIG. 3).

Dahl (U.S. Pat. No. 2,308,805) discloses a paint receptacle supporting device which can be fastened to a rung 2 and an upright 1 on either side of a ladder. In particular, the Dahl device includes a pair of jaws 9 and 10 which engage the side of a paint can to secure the can in position. Like the Berry device, this construction is rather awkward to manipulate, particularly when the operator is supported by the ladder above ground level.

Spinello (U.S. Pat. No. 2,855,170) also shows a paint bucket holder which can be attached to either side of a ladder. A bail 19 of the paint bucket 11 engages the lower end of a hook 12, whereas the upper end 9 of the hook is secured to a rung of the ladder. It is clear that this device can be used only with cans or buckets that include a bail 19 or similar means of self-support.

Toune (U.S. Pat. No. 2,912,205) discloses a paint bucket holder comprising a receptacle 4 that receives a bucket and a clamp including a pair of opposed, substantially U-shaped jaws for securing the holder to the rail of a ladder. The position of the device cannot be readily adjusted along the rail, and thus, like the Berry and Dahl devices, may be somewhat impractical to operate when one is suspended by the ladder above ground level.

Hoelzel (U.S. Pat. No. 3,104,859) relates to a paint bucket support rack comprising an angle iron or stabilizing member 8 and a length of metal formed to include a bent portion 12 for engaging the rung of a ladder and a collar-like member 23 for holding the bucket. Note that the bucket cannot be maintained level or horizontal to the ground as the ladder is tilted.

Denaro (U.S. Pat. No. 3,278,148) discloses a container support bracket formed of a single blank of sheet metal bent to the desired configuration. The device, however, is not adjustable and, once formed, cannot be adapted to support different sized containers.

Balne (U.S. Pat. No. 3,979,097) shows a ladder caddy mounted about a rail and rung of a ladder. The device, however, is only somewhat similar to the present device.

Hopkins (U.S. Pat. No. 3,987,993) and Hopkins et al (U.S. Pat. No. 4,036,463) relate to similar devices for supporting paint cans. In each case, a receptacle is mounted by clamping means to the side rail, but not to the rung, of a ladder. Moreover, the clamping means must be loosened before the device can be removed from the ladder.

SUMMARY OF THE INVENTION

A device for removably mounting a paint can from either side rail of a ladder comprises a support assembly including a channel-shaped section having a central portion with first and second side panels extending therefrom for mounting the device to either side rail of the ladder and a hook member secured to one of the side panels for supporting the device from a rung of the ladder; a receptacle comprising a cylindrical member having an open upper end for holding the paint can; and an arm secured to the receptacle and pivotably connected to the other side panel whereby the device can be mounted from either side rail of the ladder to maintain the rim of the paint can in a horizontal position regardless of the angle of incline of the ladder.

According to the foregoing description, it is an object of the present invention to provide a device that can be removably mounted against a rail and a rung of a ladder to support a paint can or the like.

It is a further object to support the paint can so that the rim of the can is maintained in a horizontal position relative to the ground regardless of the angle of incline of the ladder.

Moreover, the device can be mounted against either side rail of the ladder after a few minor adjustments.

DETAILED DESCRIPTION OF THE INVENTION

Figure 1:
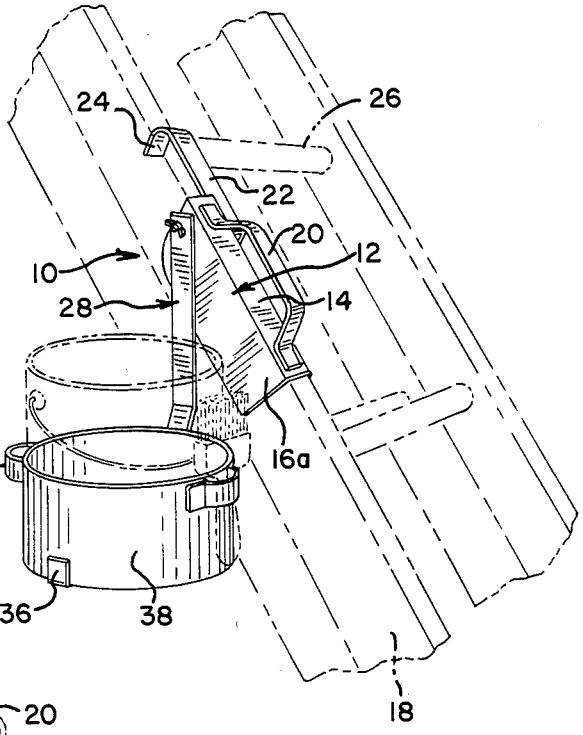
FIG. 1 is a perspective view of a first embodiment of the device removably secured to the left-hand stile of a ladder.

Referring to FIG. 1, the device of the present invention is shown removably secured to a ladder. Specifically, the device comprises a support assembly 10 including a channel-shaped section 12 having a central portion 14 and a pair of side panels **16*a* and 16*b* (see FIG. 2) which engage a stile or side rail 18 of the ladder (shown in phantom). A handle 20 can be connected to the upper surface of the central portion 14** to provide means for removing the device from the ladder.

A hook member 22 including a bent portion 24 at the upper end thereof can be fastened to the side panel **16*b* so that the bent portion engages a rung 26 of the ladder to removably support the device on the side rail 18. It will be apparent that by grasping the handle 20**, the device can be positioned on a side rail between rungs at any portion on the ladder.

Rotatably connected to the other side panel **16*a* is an L-shaped arm 28 which includes a vertical member 30** and a horizontal member 32. In particular, referring to FIG. 2, a hole 34 in the upper end of the vertical member defines the axis of rotation of the arm 28 relative to the support assembly 10 and the ladder. In addition, the lower end of the vertical member 30 can be offset relative to the upper end to provide additional clearance as the vertical arm is pivoted relative to the side rail.

The outer end of the horizontal member 32 includes an upturned flange 36 whereby a receptacle 38 or the like can be supported by the horizontal member 32 between the upturned flange 36 and the vertical member 30 of the arm 28. The receptacle 38 is preferably shaped in the form of a cylinder with an inside diameter slightly larger than the outside diameter of a one-gallon paint can (also shown in phantom in FIG. 1). Moreover, a number of C-shaped clamps or brackets 40 can be connected to the outer surface of the receptacle 38 to provide means for holding one or more paint brushes between uses.

The shape and size of the receptacle 38, of course, is not limiting to the present invention. For example, the receptacle can have an inside diameter dimensioned to hold a quart paint can. In that event, the length of the horizontal member 32 is decreased accordingly.

Figure 2:
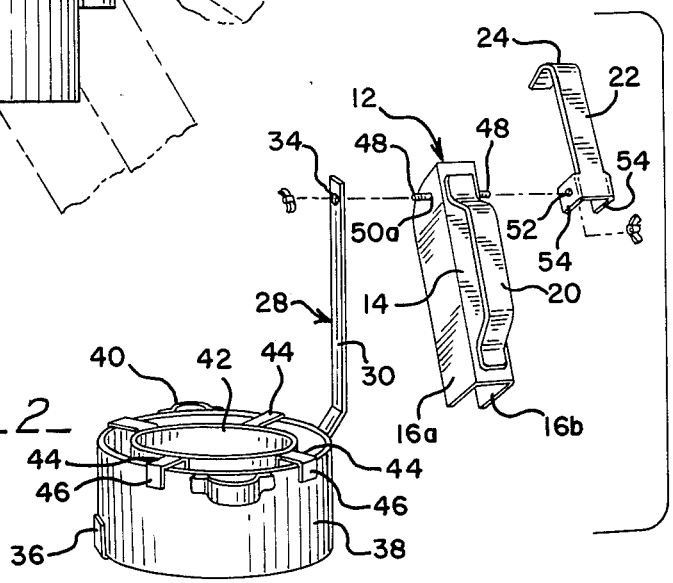
FIG. 2 is an exploded perspective view of the device of FIG. 1.
Figure 5:
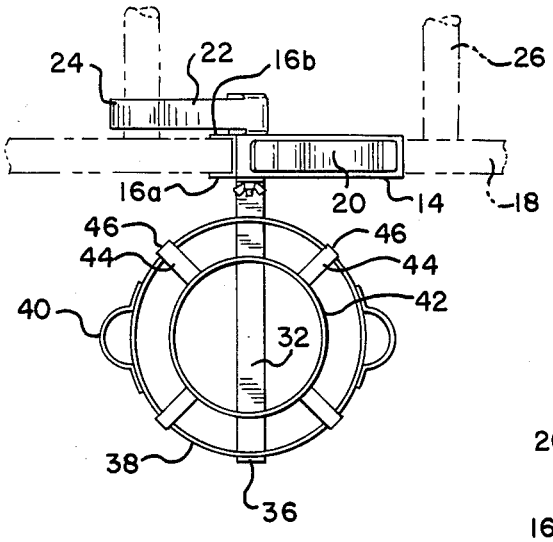
FIG. 5 is a top view of the device of FIG. 1.
Figure 4:
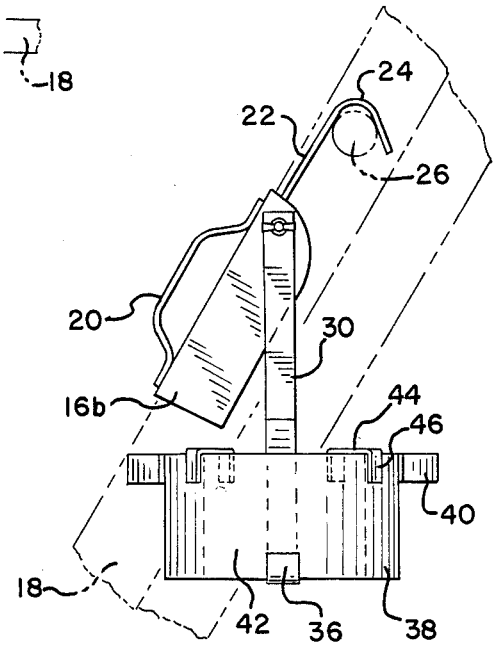
FIG. 4 is an elevational view of the device of FIG. 1 removably secured to the right-hand stile of a ladder.

In an additional embodiment, a collar member 42 having an inside diameter dimensioned to hold a quart paint can is adapted to fit within a one gallon-sized receptacle 38 (see FIGS. 2, 4 and 5). The collar member includes a plurality of clamps or arms 44 equally spaced about the collar member which extend from the outer surface of the collar member to engage the upper rim of the receptacle. In that manner, one receptacle can accommodate any number of shapes and sizes of cans. Any number of arms 44 can be employed, although at least three should be used to provide the necessary support. In the illustrated embodiment, four arms are shown and the outermost end of each arm 44 includes a downturned flange 46 for engaging the upper rim of the receptacle to hold the collar member 42 in a fixed position.

Figure 6:
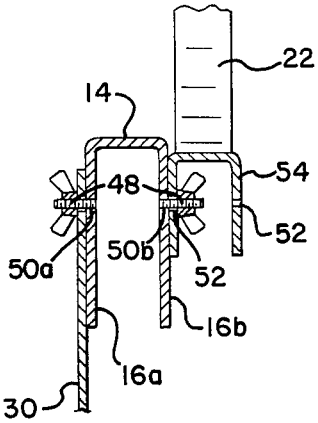
FIG. 6 is a sectional view taken along the line 6—6 of FIG. 3.

As shown in FIGS. 2 and 6, a bolt 48 or the like can extend through a pair of coaxial holes 50*a* and 50*b* in the upper portions of the side panels 16*a* and 16*b*, respectively. The bolt passing through the hole 50*a* also passes through the hole 34 of the vertical member 30 to define the axis of rotation of the arm 28.

The bolt passing through the hole 50*b* of the side panel 16*b* also passes through a hole 52 in an extension 54 connected to the lower end of the hook member 22. In a preferred embodiment, the lower end of the hook member includes a pair of opposed extensions 54, one on each side of the lower end of the hook member, whereby the hook member can be fastened to either side panel 16*a* or 16*b*. It follows that the arm 28 that supports the receptacle 38 can likewise be pivotably secured against either side panel 16*a* or 16*b*. In this manner, and as can be observed by comparing FIGS. 1 and 4, the device can be mounted on either side rail of the ladder depending on the preference of the painter.

Figure 3:
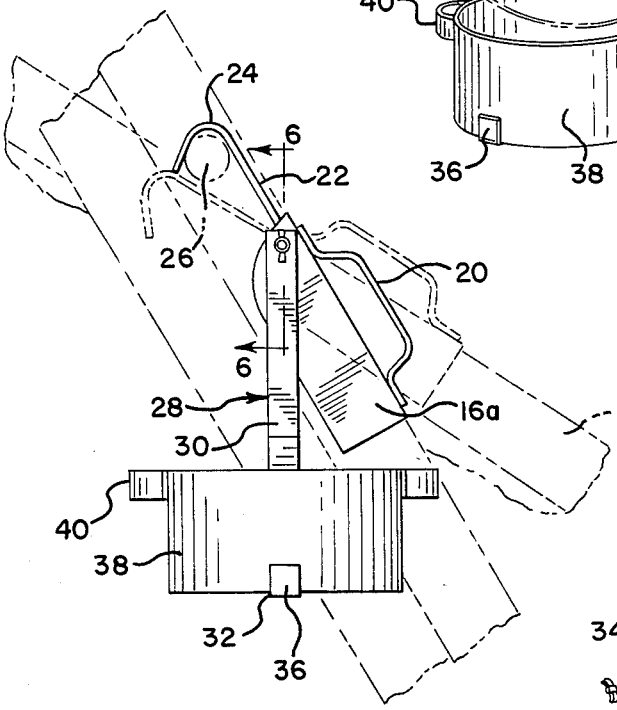
FIG. 3 is an elevational view of the device of FIG. 1.

Turning now to FIG. 3, an additional feature which contributes to the versatility of the device is illustrated. Specifically, the ladder is shown at two angles of inclination. In both positions, however, the receptacle 38 is maintained level with the ground. It should also be noted that the device can easily be mounted on a double ladder or an extension ladder because, as shown in FIGS. 1 and 3, the device need not be secured against both the top and bottom faces of the side rail. Rather, the device engages only the top face of the rail.

The relationship between the horizontal member 32 of the L-shaped arm 28 and the receptacle 38 is best shown in FIG. 5. Note that although the horizontal member 32 is relatively narrow, adequate support for a paint can or a similar object to be held within the receptacle is provided.

FIG. 6 illustrates the means for connecting the side panels 16*a* and 16*b* to the vertical member 30 of the arm 28 and the extension 54 of the hook member 22. Such means comprises a pair of nut and bolt combinations which pass through the appropriate holes. The bolts 48 should, of course, have a relatively short shaft so that a hex nut, wingnut or the like can be threaded onto the shaft. That feature is particularly important when one considers the narrow space available between the extensions 54 for threadably connecting the nut to the bolt.

Figure 7:
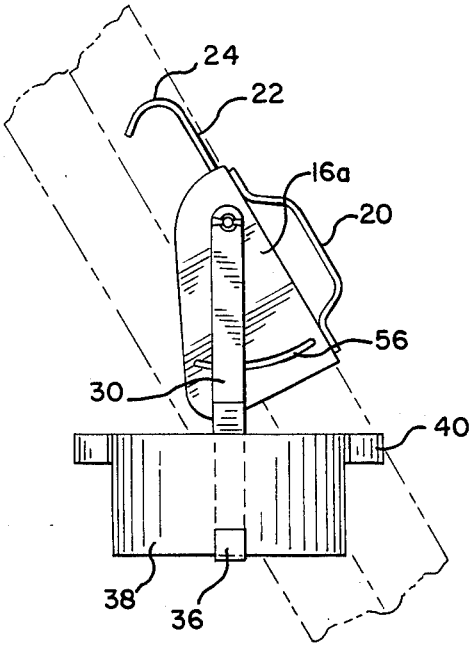
FIG. 7 is an elevational view of a second embodiment of the device removably secured to the left-hand stile of a ladder.

A further embodiment of the device is shown in FIG. 7. In particular, one or both of the side panels 16*a* and 16*b* is enlarged relative to the side panels of FIGS. 1–6. The side panel 16*a* of this embodiment is shown with an arcuate-shaped rib (or slot) 56 secured to the outer surface thereof. A tab (not shown) extending from the surface of the vertical member 30 closer to the side panel 16*a* engages the rib (or slot) 56 to provide additional support during use for the receptacle 38 and the supported load in all other respects, however, the embodiment of FIG. 7 is identical to the embodiment shown in FIGS. 1–6.

It will be understood that various changes and modifications can be made in the described invention without departing from the spirit thereof, particularly as defined in the following claims.

That which is claimed is:

1. A device for supporting and leveling a paint can from either side of a ladder comprising:

a support assembly including a U-shaped channel section having two spaced-apart side panels joined by an essentially perpendicular central portion positionable against a side rail of a ladder;

first and second bolts attached respectively to a selected region of each of said side panels so as to extend laterally from the side rail of the ladder;

a hook member adapted at an end thereof to pivotally receive one of said bolts to form a pivotable assembly and to engage a rung of the ladder thereby releasably supporting said assembly;

an elongated L-shaped arm adapted at a first end thereof to pivotally receive one of said bolts;

a cylindrical paint can receiver with an open top supported by a second end of said L-shaped arm with an upturned flange formed at said second end positioned adjacent to and affixed to said paint can receiver; and a removable collar member insertable through said top of said receiver and having arms extending therefrom for releasably engaging said top thereby centrally positioning said collar therein so as to block radial movement of a can of paint placed within said collar member and supported by said receiver.

* * * * *